US005289805A

United States Patent [19]

Quinn, Jr. et al.

[11] Patent Number: 5,289,805

[45] Date of Patent: Mar. 1, 1994

[54] SELF-CALIBRATING VARIABLE CAMSHAFT TIMING SYSTEM

[75] Inventors: Stanley B. Quinn, Jr.; Earl W. Ekdahl, both of Ithaca, N.Y.

[73] Assignee: Borg-Warner Automotive Transmission & Engine Components Corporation, Sterling Heights, Mich.

[21] Appl. No.: 995,661

[22] Filed: Dec. 16, 1992

Related U.S. Application Data

[63] Continuation-in-part of Ser. No. 847,577, Mar. 5, 1992, Pat. No. 5,184,578.

[51] Int. Cl.[5] ..... F01L 1/34

[52] U.S. Cl. ..... 123/90.17; 123/90.11; 123/90.15

[58] Field of Search ..... 123/90.17, 90.11, 90.15, 123/90.16, 90.18, 90.12; 364/424.01, 161, 157; 73/394

[56] References Cited

U.S. PATENT DOCUMENTS

| | | | |
|---|---|---|---|
| 4,313,165 | 1/1982 | Clelford et al. | 364/424 |
| 4,771,742 | 9/1988 | Nelson et al. | 123/90.17 |
| 4,787,345 | 11/1988 | Thoma | 123/90.17 |
| 4,802,376 | 2/1989 | Stidworthy | 73/394 |
| 4,856,465 | 8/1989 | Denz et al. | 123/90.17 |
| 4,993,370 | 2/1991 | Hashiyama et al. | 123/90.17 |
| 5,003,937 | 4/1991 | Matsumoto et al. | 123/90.12 |
| 5,009,203 | 4/1991 | Seki | 123/90.16 |
| 5,031,583 | 7/1991 | Konno | 123/90.16 |
| 5,080,052 | 1/1992 | Hoffa et al. | 123/90.17 |
| 5,117,785 | 6/1992 | Suga et al. | 123/90.17 |

*Primary Examiner*—Raymond A. Nelli

*Attorney, Agent, or Firm*—Willian Brinks Hofer Gilson & Lione

[57] ABSTRACT

A camshaft (26) has a vane (60) secured to an end thereof for non-oscillating rotation therewith. The camshaft also carries a sprocket (32) which can rotate with the camshaft (26) but which is also oscillatable with the camshaft (26). The vane (60) has opposed lobes (60*a*, 60*b*) which are received in opposed recesses (32*a*, 32*b*), respectively, of the sprocket (32). The recesses have greater circumferential extent than the lobes (60*a*, 60*b*) to permit the vane (60) and sprocket (32) to oscillate with respect to one another, and thereby permit the camshaft (26) to change in phase relative to a crankshaft whose phase relative to the sprocket (32) is fixed by virtue of a chain drive (38) extending therebetween.

20 Claims, 12 Drawing Sheets

SELF-CALIBRATING VARIABLE CAMSHAFT TIMING SYSTEM

CROSS-REFERENCE TO RELATED APPLICATION

This application is a continuation-in-part of co-pending application Ser. No. 07/847,577 filed on Mar. 5, 1992, now U.S. Pat. No. 5,184,578.

FIELD OF THE INVENTION

This invention relates to an internal combustion engine in which the timing of the camshaft of a single camshaft engine, or the timing of one or both of the camshafts of a dual camshaft engine, relative to the crankshaft is varied to improve one or more of the operating characteristics of the engine. More specifically, the present invention relates to a device for and a method of increasing the efficiency of the timing adjustments by compensating for inaccuracies related to system start-up or phase angle measurement.

BACKGROUND OF THE INVENTION

It is known that the performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. It is also known that engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft. Heretofore, such changes in engine valve timing have been accomplished by a separate hydraulic motor operated by engine lubricating oil. However, this actuating arrangement consumes significant additional energy and it increases the required size of the engine lubricating pump because of the required rapid response time for proper operation of the camshaft phasing actuator. Further, these arrangements are typically limited to a total of 20° of phase adjustment between crankshaft position and camshaft position, and typically such arrangements are two-position arrangements, that is, on, or fully phase adjusted as one position, or off, or no phase adjustment, as a second position. The present invention is designed to overcome these problems associated with prior art variable camshaft timing arrangements by providing a self-actuating, variable camshaft timing arrangement which does not require external energy for the operation thereof, which does not add to the required size of the engine lubricating pump to meet transient hydraulic operation requirements of such variable camshaft timing arrangement, which provides for continuously variable camshaft to crankshaft phase relationship within its operating limits, and which provides substantially more than 20° of phase adjustment between the crankshaft position and the camshaft position. Prior U.S. Patents which describe various systems of the foregoing type are U.S. Pat. Nos. 5,046,460, 5,002,023, and 5,107,804, the disclosures of each of which are hereby incorporated by reference.

Inventions disclosed in the prior art provide a method for phase adjustment of an internal combustion engine in which the position of the camshaft, or the positions of one or both of the camshafts in a dual camshaft system, is phase adjusted relative to the crankshaft by an actuating arrangement. Such an arrangement is controlled by a robust closed loop system having a hydraulic pilot stage with a pulse width modulated (PWM) solenoid, for example, a system such as generally disclosed by co-pending U.S. patent application Ser. No. 07/847,577, which is hereby incorporated by reference. A predetermined set point dictates the desired camshaft phase angle for certain engine performance criteria. This variable camshaft timing (VCT) system can be used to improve important engine operating characteristics such as idle quality, fuel economy, emissions or torque. A preferred embodiment of a camshaft mounted hydraulic VCT mechanism uses one or more radially extending vanes which are circumferentially fixed relative to the camshaft and which are receivable in cavities of a sprocket housing that is oscillatable on the camshaft. Hydraulic fluid is selectively pumped through a proportional (spool) valve to one side or another of each vane to advance or retard the position of the camshaft relative to the sprocket. A pumping action occurs in reaction to a signal generated by a closed loop feedback system. Closed loop feedback control is imperative for any but the "two-position" case, i.e., fully advanced or fully retarded. This is because camshaft phase is controlled by the integral of the spool valve position. That is, spool position corresponds not to camshaft phase, but to its rate of change. Thus, any steady state spool position other than null (centered) will cause the VCT to eventually go to one of its physical limits in phase. Closed loop control allows the spool to be returned to null as the camshaft phase reaches its commanded position or set point. An additional result of using feedback control is that the system performance is desensitized to mechanical and environmental variations. This results in a reduction of the effects of short term changes, such as changes in oil pressure or temperature, or long term variations due to tolerances or wear. In addition, set point tracking error in the presence of unanticipated disturbances (e.g. torque shifts) is reduced. A degree of sensitivity reduction and disturbance rejection is referred to as the "robustness" of the control system. Closed loop control can thus provide stable set point tracking with some degree of robustness.

SUMMARY OF THE INVENTION

While the method described in the aforementioned U.S. patent application Ser. No. 07/847,577, provides many advantages over previous methods of improving engine performance via adjusting the phase between crankshaft and camshaft, difficulties can arise. First, mechanical inaccuracies may develop in the phase measurement stage of the phase-adjusting process. In the past a phase offset was manually calculated and added to the control logic to compensate for these inaccuracies. The present invention makes it possible to calculate the necessary phase offset automatically, both at the start-up of the system and as necessary thereafter, thus resulting in a self-calibrating VCT system.

Another difficulty occasionally arises when the phase of the system advances so far that a wrong, i.e. preceding, pulse is used to calculate the phase instead of the correct pulse. Accordingly, the computed phase angle will look like a large positive (retard) value rather than the correct slightly negative (advance) value. This problem called "pulse crossover" is corrected by compensating the incorrect phase measurement using the previously determined phase offset, Z.

Accordingly, it is an object of the present invention to provide an improved VCT method which utilizes a hydraulic PWM spool position control and an advanced control algorithm that yields a prescribed set point tracking behavior with a high degree of robustness. Further, it is an object of the present invention to provide a VCT method of the foregoing type which maintains substantially unchanged performance over a wide range of parameter variations, including those variations which may be generated during system start-up or phase measurement, as well as commonplace variations in engine parameters such as fluctuations in engine oil pressure, component tolerances, spring rate, and air entrainment and leakage.

For a further understanding of the present invention and the objects thereof, attention is directed to the drawings and to the following brief descriptions thereof, to the detailed description of the preferred embodiment, and to the appended claims.

DETAILED DESCRIPTION OF THE PREFERRED EMBODIMENT

Introduction

Figure 1A:
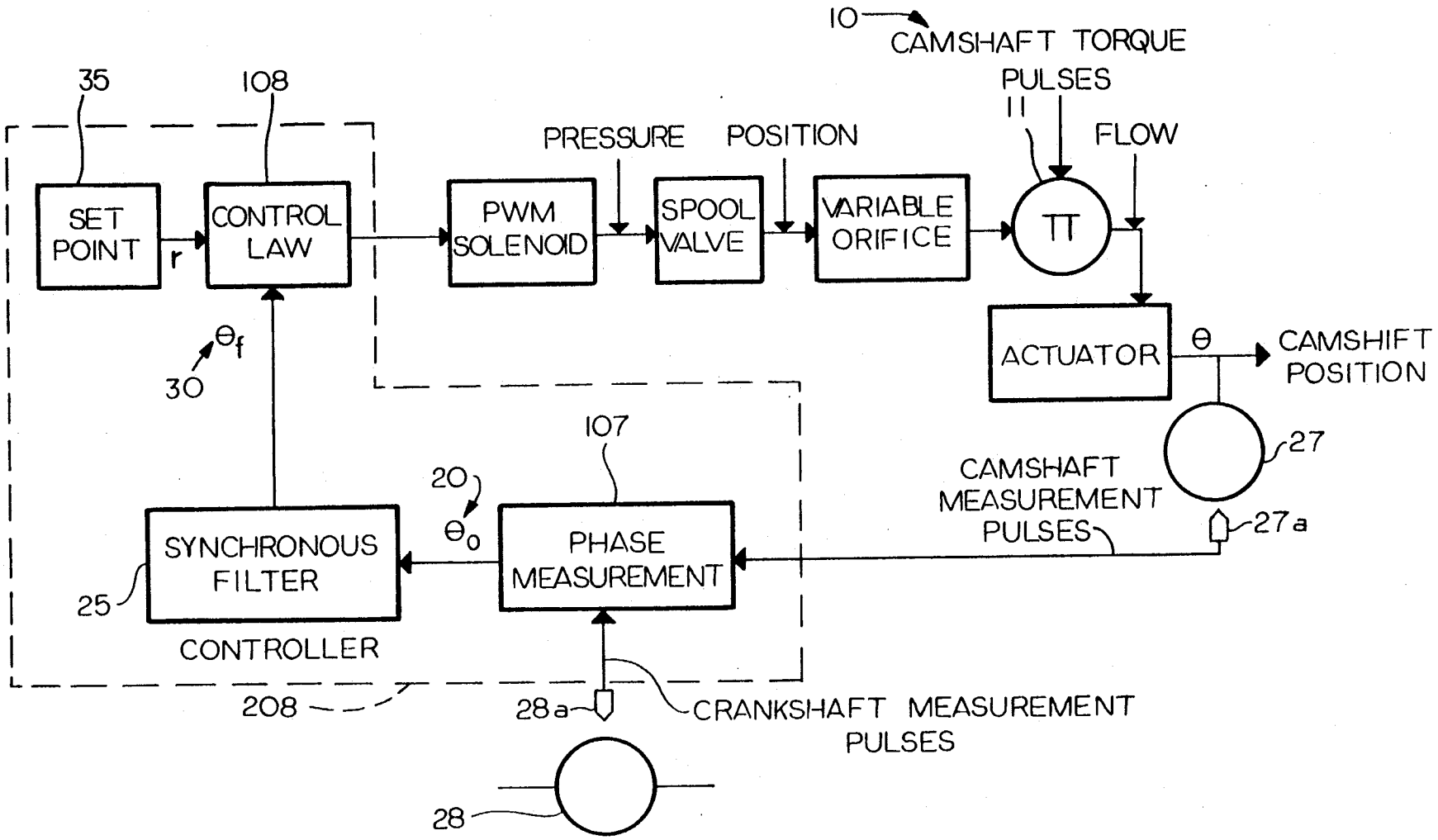
FIG. 1*a* is a block diagram of an improved closed loop feedback system for a VCT system.

As is described in the aforesaid U.S. Pat. Nos. 5,046,460 and 5,002,023 and as is schematically shown in FIG. 1*a*, camshaft measurement pulses are generated by a camshaft pulse wheel 27 as the camshaft 26 rotates during engine operation. The camshaft pulses are detected by camshaft pulse sensor 27*a* and then transmitted for phase measurement and compensation 107. Crankshaft measurement pulses are generated, sensed, and transmitted in an identical manner utilizing crankshaft pulse wheel 28 and crankshaft pulse sensor 28*a*. These pulses can be used to determine the position of the camshaft relative to the crankshaft and then actuate the operation of one or more hydraulic elements of a hydraulically operated VCT system accordingly.

The following assumptions are made for the purposes of the present invention:

1) only equally spaced measurement pulses are used for phase calculation (any extra pulses are ignored), i.e. N=the number of crankshaft pulses per pulse wheel revolution, and M=the number of camshaft pulses per pulse wheel revolution;
2) the maximum phase variation in cam degrees is less than 360°/M; and,
3) the maximum phase variation in crank degrees is less than 360°/N.

The following variables are used for the purposes of the present invention:

1) $K_1$=360°/N in crankshaft degrees per crankshaft pulse;
2) $K_2$=2(360°/M) in crankshaft degrees per camshaft pulse;
3) Z=phase offset in degrees;
4) PHMIN=minimum phase variation in degrees;
5) PHMAX=maximum phase variation in degrees;
6) LCAMPW=elapsed time in seconds between trailing edges of crankshaft and camshaft pulses; and,
7) NEPW=elapsed time in seconds between successive crankshaft pulses.

Initial Calibration

Typically, a phase offset is added to the phase angle measurement to correct for physical misalignment of the pulse wheels. In the past, the offset was determined experimentally and incorporated into the control logic. The offset thus allowed calibration of the phase measurement range to correspond directly to the true physical position of the VCT system. According to the present invention, this offset is determined automatically. Initial calibration 105 of the system is implemented upon start-up of the VCT system when it is forced to the full advance position, prior to utilizing the control law 108 and setpoint 35 inputs. At program initialization, a recalibration "flag" is set to logical "true" to indicate that calibration is required. The initialization stage occurs during approximately the first two seconds of operation. The value of the phase offset, Z, is equal to zero, since no phase angle has yet been measured. Following program initialization, the process enters the calibration mode where the duty cycle is set at its minimum and the smallest value of the phase seen, $\theta_{min}$, is monitored. This $\theta_{min}$ is used to calculate the phase offset, Z, as follows:

$$Z=\theta_{min}-\text{PHMIN}$$

Substituting the formula for determining a phase angle as described in the prior art, then:

$$Z = \frac{LCAMPW}{NEPW} \times \frac{360^\circ}{N} - PHMIN$$

Thus the phase offset, Z, is automatically calculated during the initial calibration stage 105 of VCT system operation, eliminating the need to calculate a fixed offset "by hand" prior to system start-up. The calibration procedure may be repeated during operation whenever the VCT system is forced to the full advance position.

Phase Measurement and Compensation

Immediately following initial calibration 105, the raw phase angle, $\theta_1$ (not shown), between the crankshaft and the camshaft 26 is continuosly calculated using the crankshaft and camshaft pulses, shown in FIGS. 1*g* and 1*h*, as follows:

$$\theta_1 = \frac{LCAMPW}{NEPW} \times \frac{360^\circ}{N}$$

where:

$\theta_1$=raw phase angle;

LCAMPW 2,4=time between trailing edges of crankshaft and camshaft pulses;

NEPW 1,3=time beween successive crankshaft pulses; and,

N=number of crankshaft pulses.

Figure 1B:
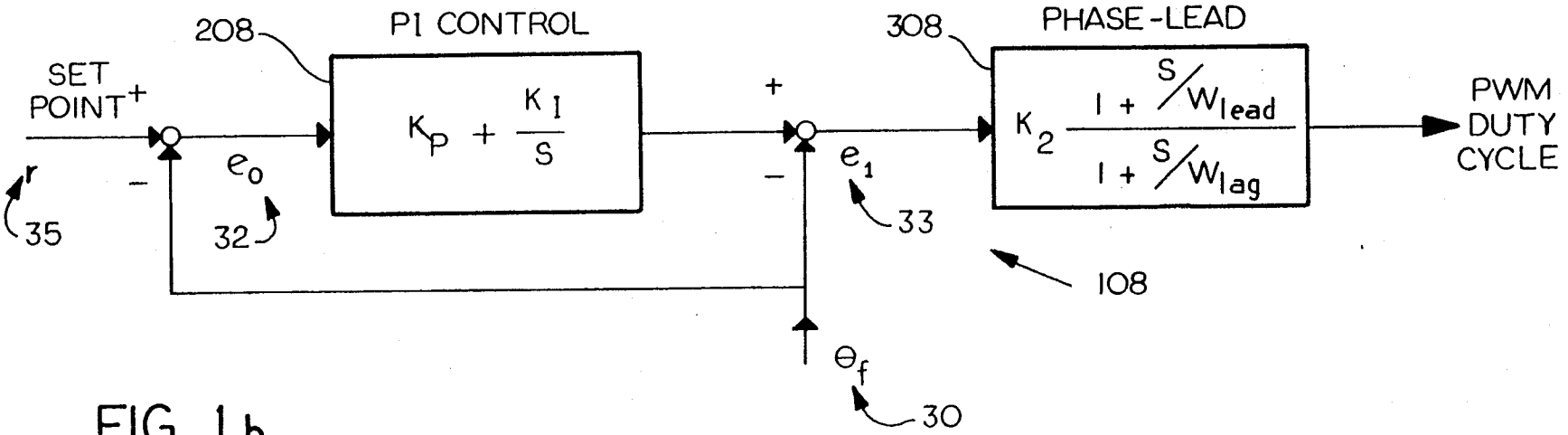
FIG. 1*b* is a block diagram of the robust VCT control law of a preferred embodiment of the present invention used in a closed loop feedback system.
Figure 1C:
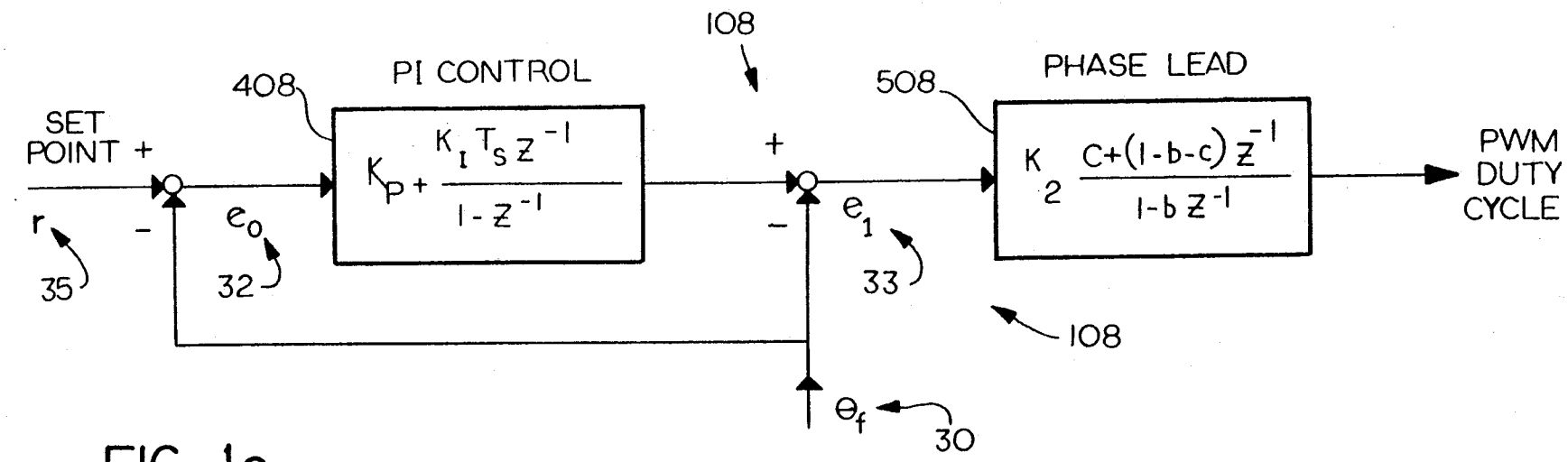
FIG. 1*c* is a block diagram of the digital implementation of the robust VCT control law illustrated in FIG. 1*b;*
Figure 1D:
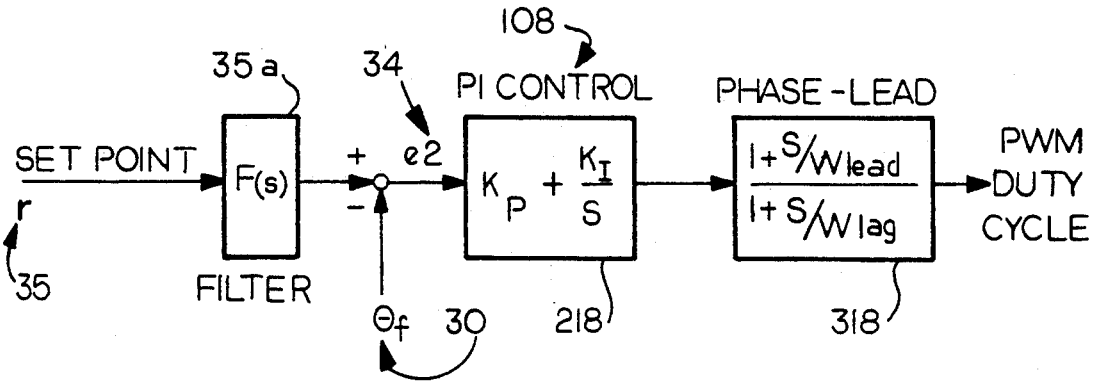
FIG. 1*d* is a block diagram of the robust VCT control law of an alternate embodiment of the present invention utilizing a single-loop configuration and filtered set point.
Figure 1F:
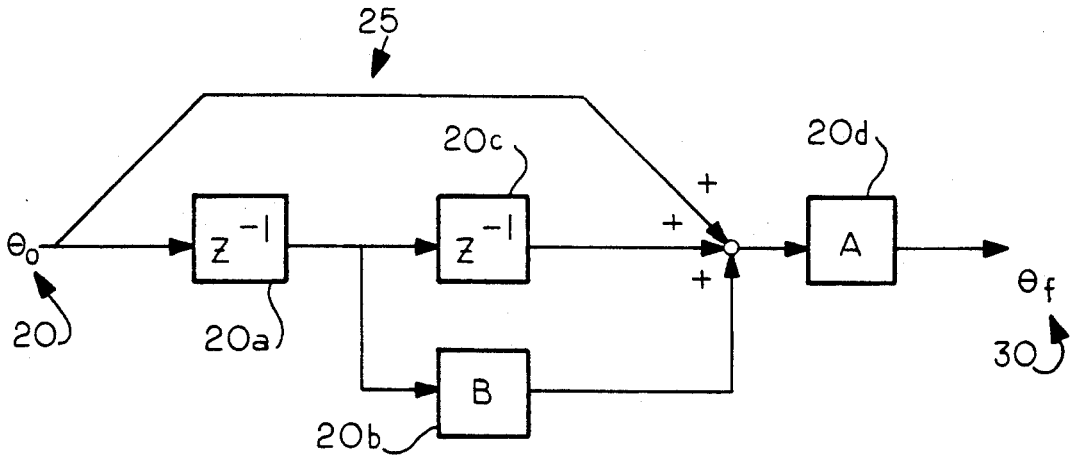
FIG. 1*f* is a block diagram illustrating the component stages of a synchronous feedback filter.
Figure 1E:
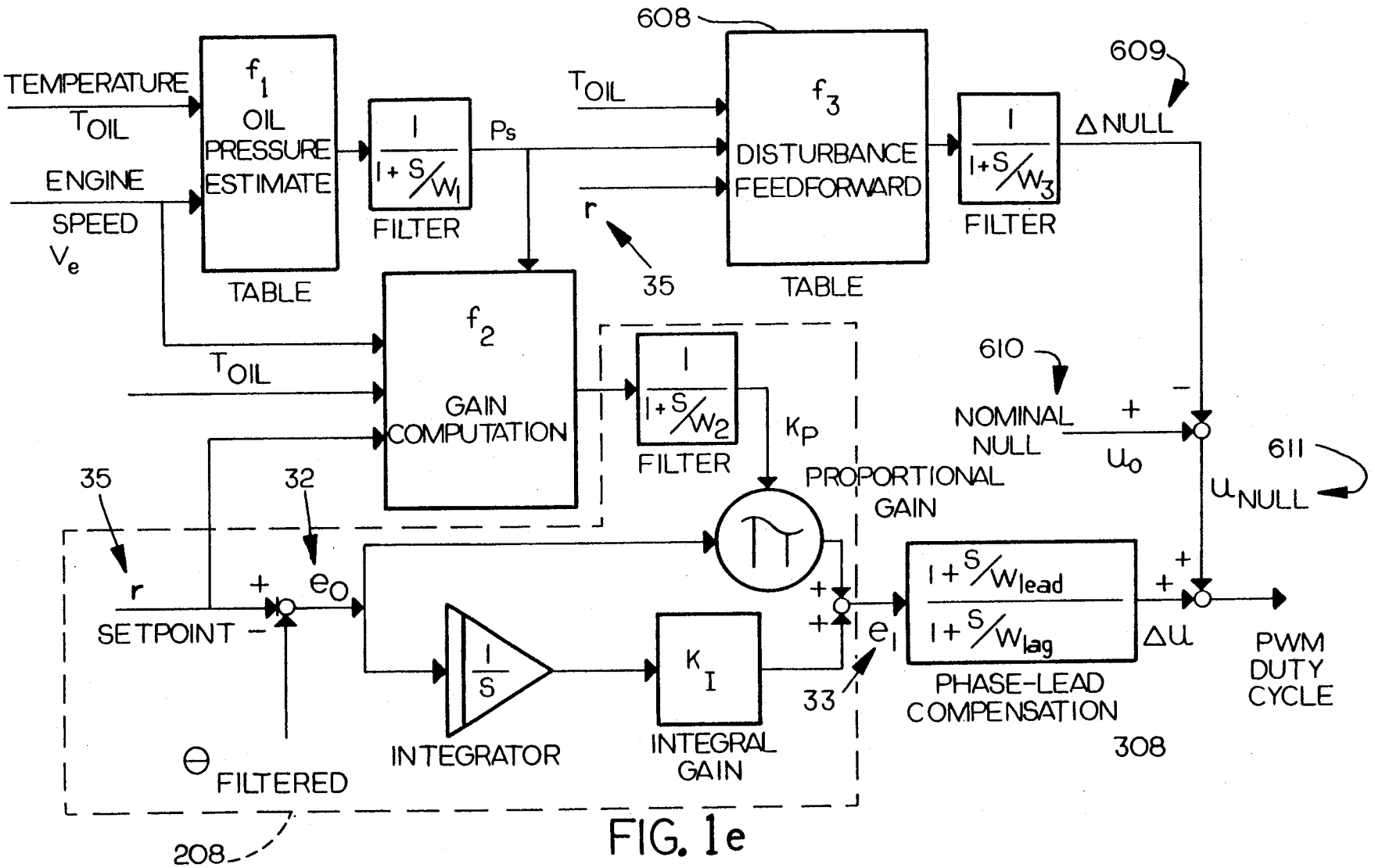
FIG. 1*e* is a block diagram of the robust VCT control law of an alternate embodiment of the present invention including variation compensation and disturbance feedforward.
Figure 1G:
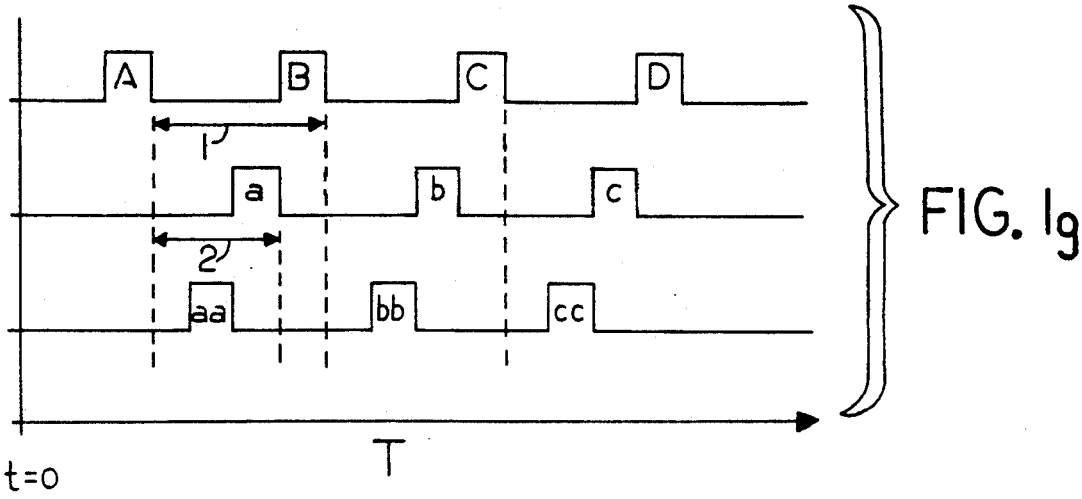
FIG. 1*g* is a phase measurement pulse timing diagram for the VCT system in the normal operating position.

When the system is in the normal operating position illustrated in FIG. 1*g*, the raw phase $\theta_1$ can be accurately determined. The appropriate camshaft pulses a and aa occur between the crankshaft pulses A and B in time, i.e. PHMIN$<\theta_1<$PHMAX and therefore $\theta_2=\theta_1$. In this position the times used to calculate the raw phase $\theta_1$ are LCAMPW=$t_{Aa}$ 2 and NEPW=$t_{AB}$ 1.

Figure 1H:
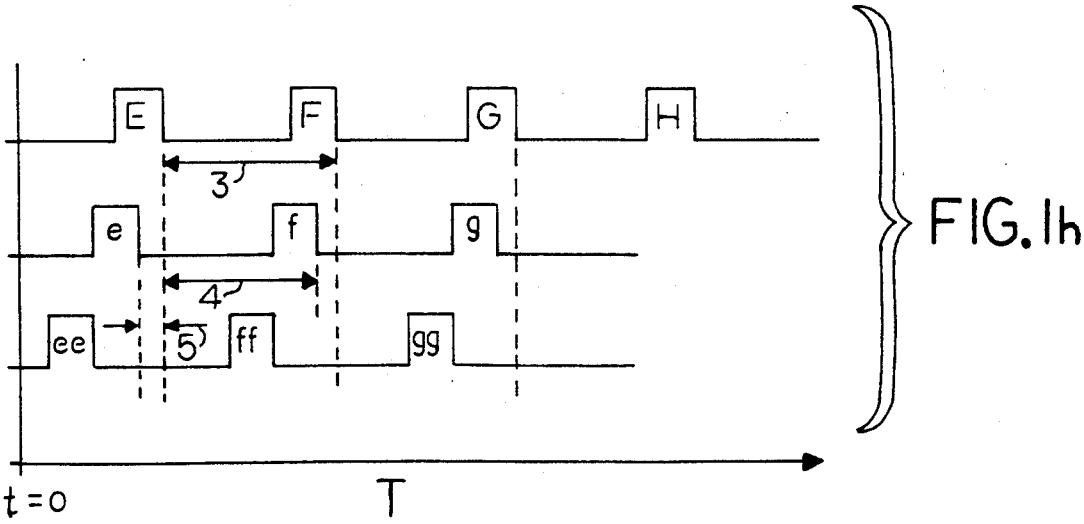
FIG. 1*h* is a phase measurement pulse timing diagram for the VCT system in the advance position.
Figure 2:
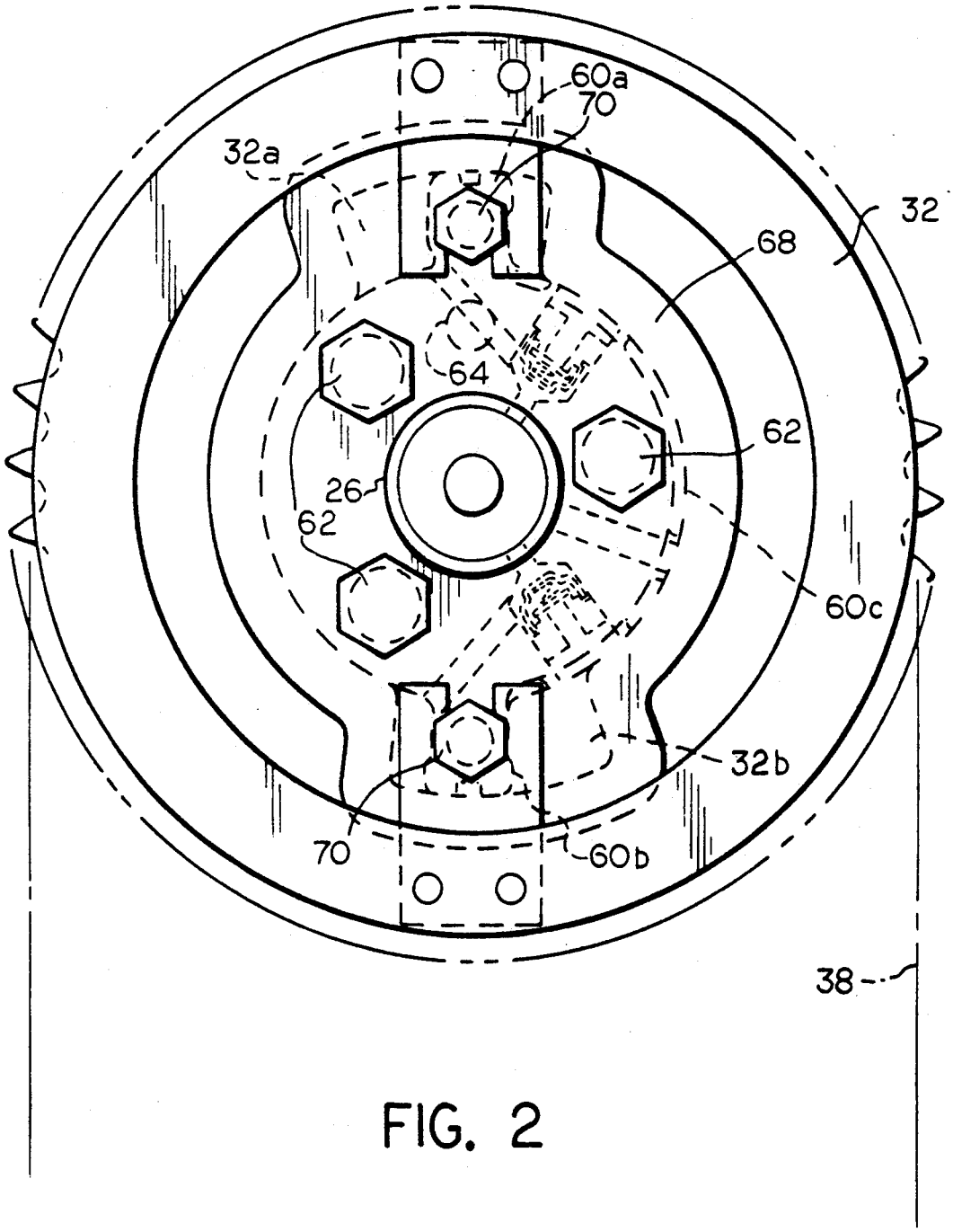
FIG. 2 is an end elevational view of a camshaft with an embodiment of a variable camshaft timing system applied thereto.
Figure 3:
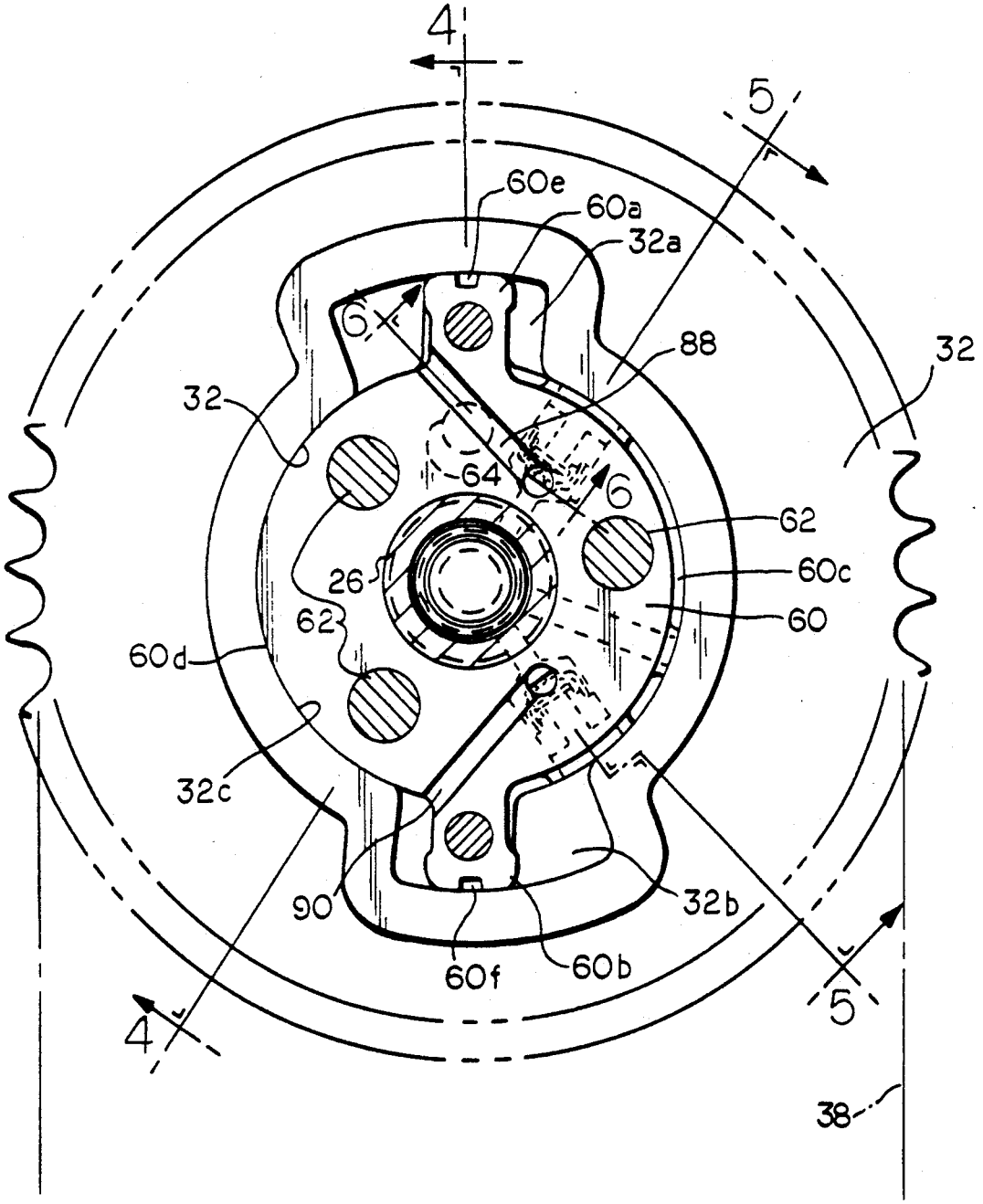
FIG. 3 is a view similar to FIG. 2 with a portion of the structure thereof removed to more clearly illustrate other portions thereof.

However, in the advance position illustrated in FIG. 1*h*, without the benefit of the present invention, the correct camshaft pulse e for accurately calculating the raw phase $\theta_1$ (not shown) precedes the crankshaft pulse E in time, so the system incorrectly looks to the following pulse f to determine the raw phase $\theta_1$ (not shown). While the time between crankshaft pulses NEPW=$t_{EF}$ 3 is constant and therefore correct, the incorrect camshaft time LCAMPW=$t_{Ef}$ 4 is used to calculate the phase instead of the correct time LCAMPW=$t_{Ee}$ 5. Because the system uses the wrong ("crossed over") camshaft pulse f to determine the raw phase $\theta_1$, the result is a large positive (retard) phase value which is incorrect instead of the correct slightly negative (advance) phase value.

To resolve the problem described above, the following formula is incorporated into the phase measurement and compensation stage 107:

$$\theta_2 = K_1\left(\frac{LCAMPW}{NEPW}\right) - Z$$

where $\theta_2$ 20=compensated phase angle. During the full advance position, i.e. when $\theta_1>$PHMAX, $$\theta_2 = \theta_1 - K_2$$

or $$\theta_2 = K_1\left(\frac{LCAMPW}{NEPW}\right) - Z - K_2$$

Similarly, if the system is in the retard position (not shown), i.e. $\theta_1<$PHMIN and the crankshaft and camshaft pulses are "crossed over," but in the opposite direction, then:

$$\theta_2 = \theta_1 - K_2$$

or $$\theta_2 = K_1\left(\frac{LCAMPW}{NEPW}\right) - Z + K_2$$

The overall goal is thus achieved. The phase measurement automatically indicates the true physical position of the VCT.

Phase Filtering

The phase measurement $\theta_2$ 20 is then supplied to a synchronous filter 25, schematically shown in FIG. 1*f*. As the camshaft rotates, the torque pulses 10 superimpose a high frequency disturbance on the true VCT phase, $\theta$ 40. Thus, there is an exact synchronization between the torque pulses 10 and the high frequency disturbance. Likewise, the camshaft measurement pulses 27*a* are also synchronized with the disturbance. According to the present invention it is possible to take advantage of this synchronization to efficiently filter the compensated phase measurement, $\theta_2$ 20, so that the high frequency disturbance is isolated from the control action. As the camshaft speed varies, the filter frequency automatically tracks the disturbance frequency. The filter 25 itself is a discrete-time notch filter with a sampling frequency equal to that of the camshaft measurement pulse frequency 27*a*. The filtered phase measurement, $\theta_f$ 30, is then supplied to the control law 108. Since the high frequency disturbance is isolated, the control law 108 does not attempt to compensate for it. This further makes it possible to save actuation power, reduce wear and enhance signal linearity by such a filtering step herein described.

FIG. 1*f* illustrates an embodiment for the filter 25 in the case when the number of camshaft measurement pulses per revolution (n) is greater than twice the number of torque pulses per revolution (m). The filter 25 eliminates the fundamental frequency of the torque disturbance. In the case when $n<2m$, the disturbance is "aliased" to a lower frequency and this is the frequency addressed by the filter 25. Further stages can also be added to eliminate harmonics of the disturbance frequency.

The variables for FIG. 1*f* are as follows:

$z^{-1}$=delay by one camshaft measurement pulse $B = -2\cos(2\pi m/n)$
$A = 1/(2+B)$

Control Law

The compensated filtered phase signal $\theta_f$ 30 is then subjected to the control law 108, which is described in detail in FIG. 1b. The signal $\theta_f$30 is first conditioned by a proportional-integral control block 208 where the compensated filtered phase signal, $\theta_f$ 30, is subtracted from a set point r 35 to give the tracking error, $e_o$ 32. The tracking error $e_o$ 32 is then processed by a proportional-integral (PI) control block 208 to give infinite DC gain as well as phase lead to compensate for integrator lag. The integral action assures that the steady-state tracking error goes to zero.

The output of the PI control block 208 is then used to control the "inner loop" of the system. The filtered phase angle measurement $\theta_f$ 30 is subtracted from it, resulting in an inner loop error, $e_1$ 33. This loop error $e_1$ 33 is multiplied by a loop gain, $K_2$, and subjected to the effect of a phase-lead compensation 308. Such phase-lead compensation 308 gives a quick response by substantially canceling the low frequency phase lag of the PWM pilot stage 106 (shown in FIGS. 1a and 11). The gains and phase-lead frequencies provide enough freedom to achieve independent control of closed-loop dynamics and robustness.

FIG. 1c shows the identical feedback control law 108 for digital implementation. The variables for the PI control block 408 are:

$T_S = 0.02$ sec.
$z^{-1}$ = unit delay

The variables for the phase-lead compensation block 508 are:

$c = w_{lag}/w_{lead}$
$B = \exp - w_{lag} T_S$

The VCT Vane System

FIGS. 2–10 illustrate an embodiment of a hydraulic vane system in which a housing in the form of a sprocket 32 is oscillatingly journalled on a camshaft 26. The camshaft 26 may be considered to be the only camshaft of a single camshaft engine, either of the overhead camshaft type or the inblock camshaft type. Alternatively, the camshaft 26 may be considered to be either the intake valve operating camshaft or the exhaust valve operating camshaft of the dual camshaft engine. In any case, the sprocket 32 and the camshaft 26 are rotatable together, and are caused to rotate by the application of torque to the sprocket 32 by an endless roller chain 38, shown fragmentarily, which is trained around the sprocket 32 and also around a crankshaft not shown. As will be here after described in greater detail, the sprocket 32 is oscillatingly journalled on the camshaft 26 so that it is oscillatable at least through a limited arc with respect to the camshaft 26 during the rotation of the camshaft, an action which will adjust the phase of the camshaft 26 relative to the crankshaft.

An annular pumping vane 60 is fixedly positioned on the camshaft 26, the vane 60 having a diametrically opposed pair of radially outwardly projecting lobes 60a, 60b and being attached to an enlarged end portion 26a of the camshaft by bolts 62 which pass through the vane 60 into the end portion 26a. In that regard, the camshaft 26 is also provided with a thrust shoulder 26b to permit the camshaft to be accurately positioned relative to an associated engine block, not shown. The pumping vane 60 is also precisely positioned relative to the end portion 26a by a dowel pin 64 which extends therebetween. The lobes 60a, 60b are received in radially outwardly projecting recesses 32a, 32b, respectively, of the sprocket 32, the circumferential extent of each of the recesses 32a, 32b being somewhat greater than the circumferential extent of the vane lobes 60a, 60b which are received in such recesses to permit limited oscillating movement of the sprocket 32 relative to the vane 60. The recesses 32a, 32b are closed around the lobes 60a, 60b, respectively, by spaced apart, transversely extending annular plates 66, 68 which are fixed relative to the vane 60, and, thus, relative to the camshaft 60, by bolts 70 which extend from one to the other through the same lobe, 60a or 60b. Further, the inside diameter 32c of the sprocket 32 is sealed with respect to the outside diameter of the portion 60d of the vane 60 which is between the lobe 60a, 60b, and the tips of the lobes 60a, 60b of the vane 60 are provided with sealed receiving slots 60e, 60f, respectively. Thus, each of the recesses 32a, 32b of the sprocket 32 is capable of sustaining hydraulic pressure, and within each recess 32a, 32b, the portion on each side of the lobe 60a, 60b, respectively, is capable of sustaining hydraulic pressure.

Figure 11:
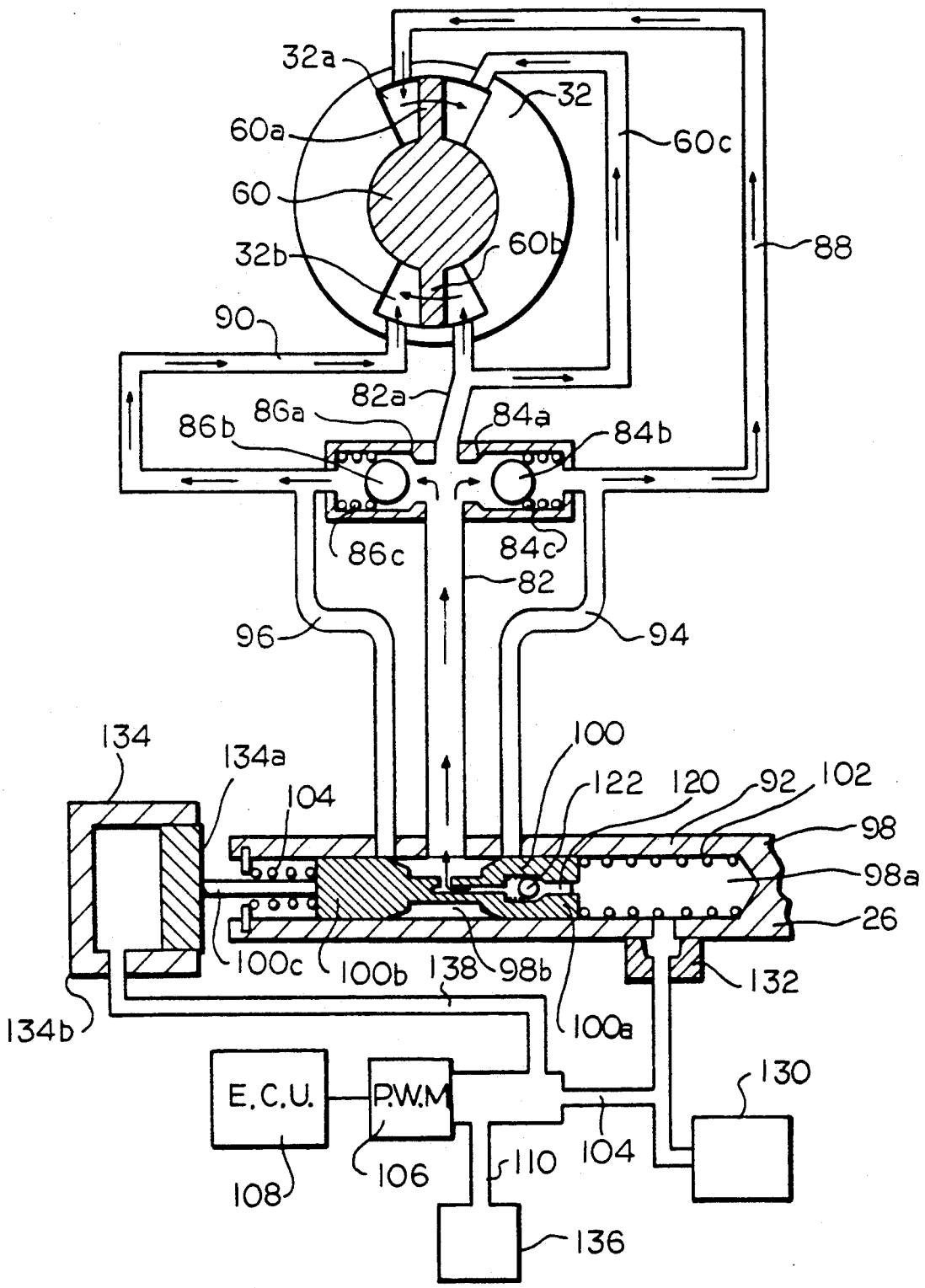
FIG. 11 is a simplified schematic view of the variable camshaft timing arrangement of FIGS. 2-10.

The functioning of the structure of the embodiment of FIGS. 2–10, as thus far described, may be understood by reference to FIG. 11. Hydraulic fluid, illustratively in the form of engine lubricating oil, flows into the recesses 32a, 32b by way of a common inlet line 82. The inlet line 82 terminates at a juncture between opposed check valves 84 and 86 which are connected to the recesses 32a, 32b, respectively, by branch lines 88, 90, respectively. The check valves 84, 86 have annular seats 84a, 86a, respectively, to permit the flow of hydraulic fluid through the check valves 84, 86 into the recesses 32a, 32b, respectively. The flow of hydraulic fluids through the check valves 84, 86, is blocked by floating balls 84b, 86b, respectively, which are resiliently urged against the seats 84a, 86a, respectively, by springs 84c, 86c, respectively. The check valves 84, 86, thus permit the initial filling of the recesses 32a, 32b and provide for a continuous supply of makeup hydraulic fluid to compensate for leakage therefrom. Hydraulic fluid enters the line 82 by way of a spool valve 92, which is incorporated within the camshaft 26, and hydraulic fluid is returned to the spool valve 92 from the recesses 32a, 32b by return lines 94, 96, respectively. Because of the location of the check valves 84 and 86 which block the backflow of hydraulic fluid, the need for the spool valve 100 to return to the null (centered) position to prevent such backflow is eliminated.

The spool valve 92 is made up of a cylindrical member 98 and a spool 100 which is slidable to and fro within the member 98. The spool 100 has cylindrical lands 100a and 100b on opposed ends thereof, and the lands 100a and 100b, which fit snugly within the member 98, are positioned so that the land 100b will block the exit of hydraulic fluid from the return line 96, or the land 100a will block the exit of hydraulic fluid from the return line 94, or the lands 100a and 100b will block the exit of hydraulic fluid from both return lines 94 and 96, as is shown in FIG. 11, where the camshaft 26 is being maintained in a selective intermediate position relative to the crankshaft of the associated engine.

The position of the spool 100 within the member 98 is influenced by an opposed pair of springs 102, 104 which act on the ends of the lands 100a, 100b respectively. Thus, the spring 102 resiliently urges the spool 100 to the left, in the orientation illustrated in FIG. 11, and the spring 104 resiliently urges the spool 100 to the right in such orientation. The position of the spool 100 within the member 98 is further influenced by supply of pressurized hydraulic fluid within a portion 98*a* of the member 98, on the outside of the land 100*a*, which urges the spool 100 to the left. The portion 98*a* of the member 98 receives its pressurized fluid (engine oil) directly from the main oil gallery ("MOG") 130 of the engine, and this oil is also used to lubricate a bearing 132 in which the camshaft 26 of the engine rotates.

The control of the position of the spool 100 within the member 98 is in response to hydraulic pressure within a control pressure cylinder 134 whose piston 134*a* bears against an extension 100*c* of the spool 100. The surface area of the piston 134*a* is greater than the surface area of the end of the spool 100 which is exposed to hydraulic pressure within the portion 98*a*, and is preferably twice as great. Thus, the hydraulic pressures which act in opposite directions on the spool 100 will be in balance when the pressure within the cylinder 134 is one-half that of the pressure within the portion 98*a*. This facilitates the control of the position of the spool 100 in that, if the springs 102 and 104 are balanced, the spool 100 will remain in its null or centered position, as illustrated in FIG. 11, with less than full engine oil pressure in the cylinder 134, thus allowing the spool 100 to be moved in either direction by increasing or decreasing the pressure in the cylinder 134, as the case may be.

Figure 4:
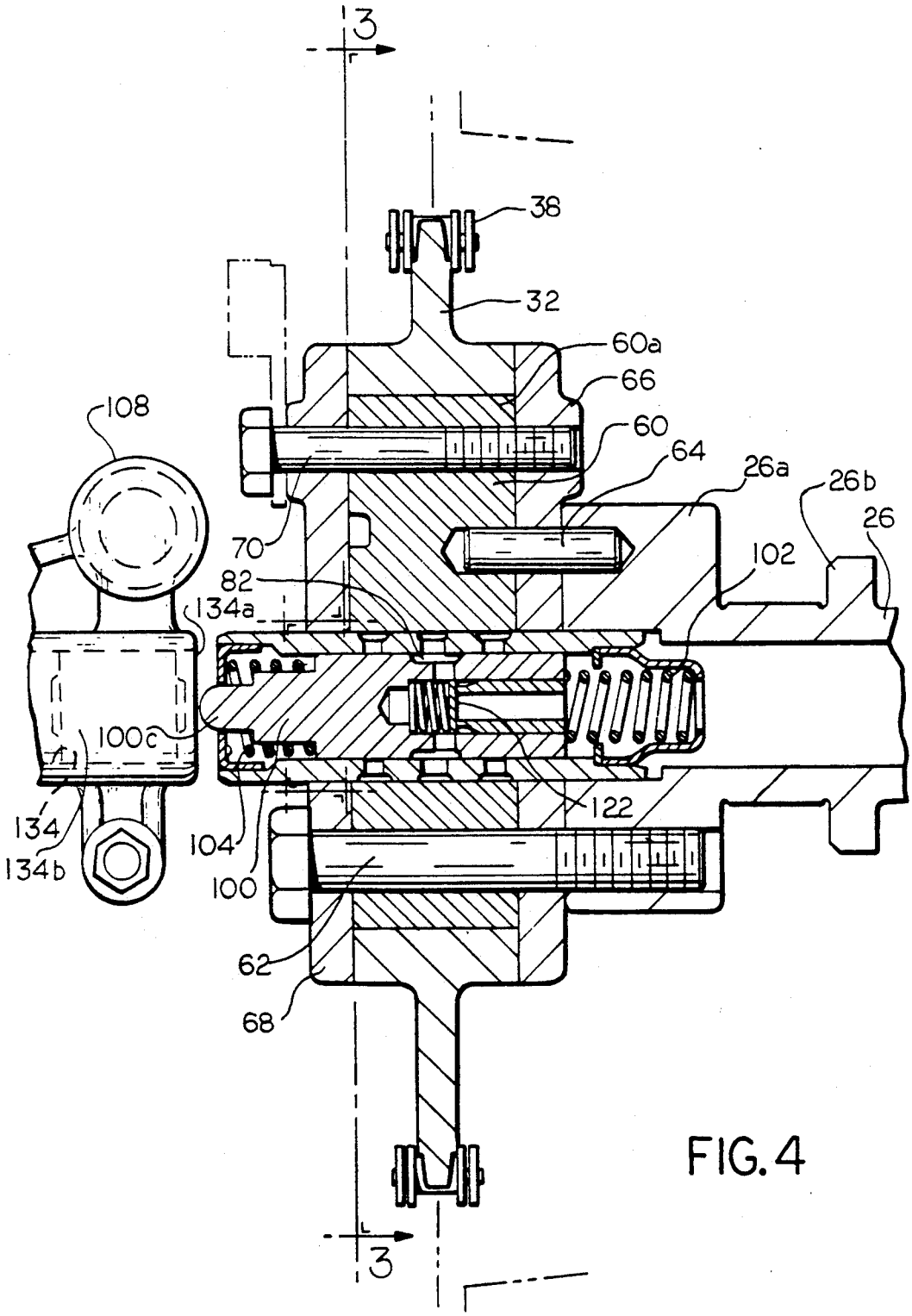
FIG. 4 is a sectional view taken along line 4—4 of FIG. 3.
Figure 5:
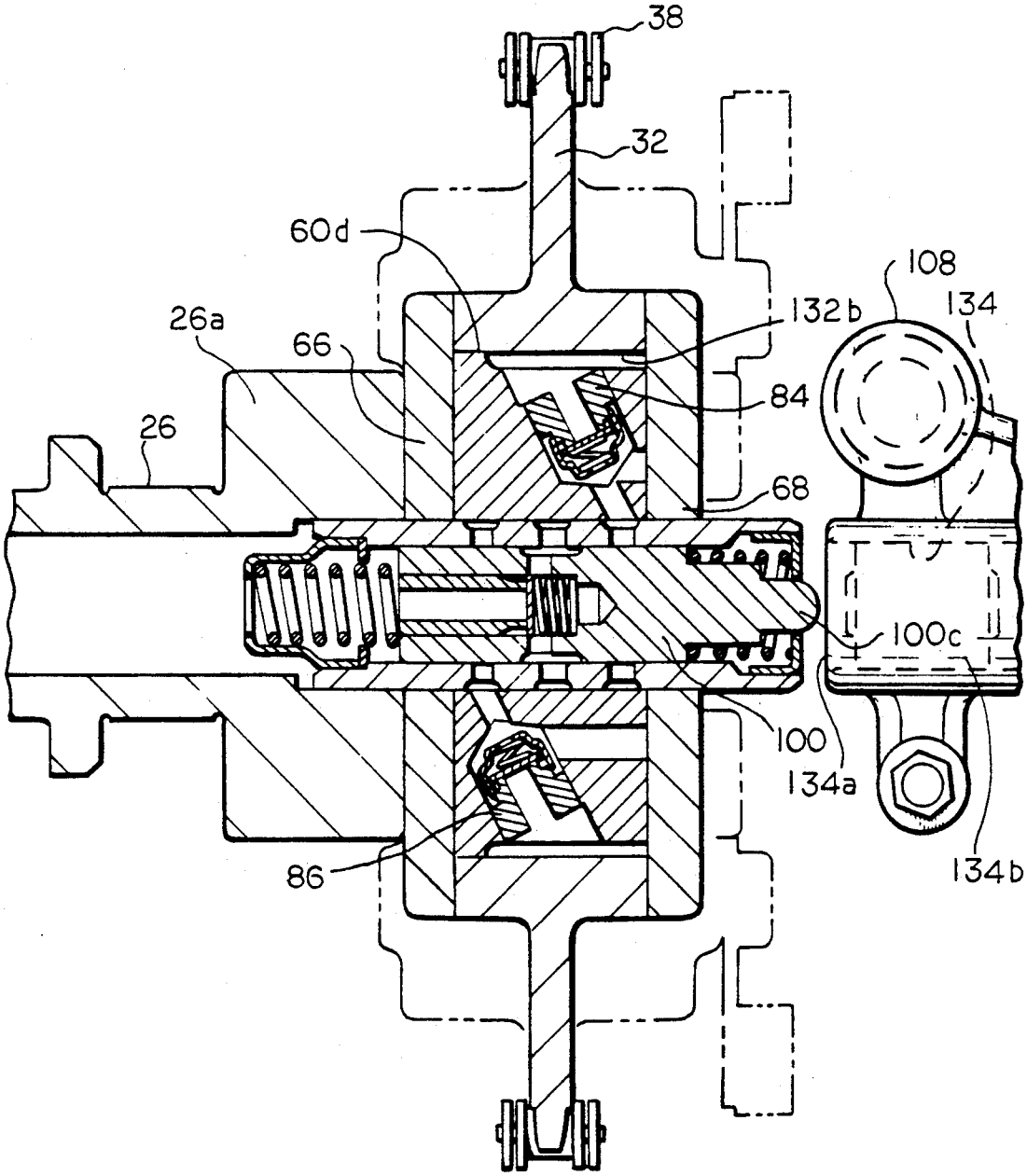
FIG. 5 is a sectional view taken along line 5—5 of FIG. 3.
Figure 7:
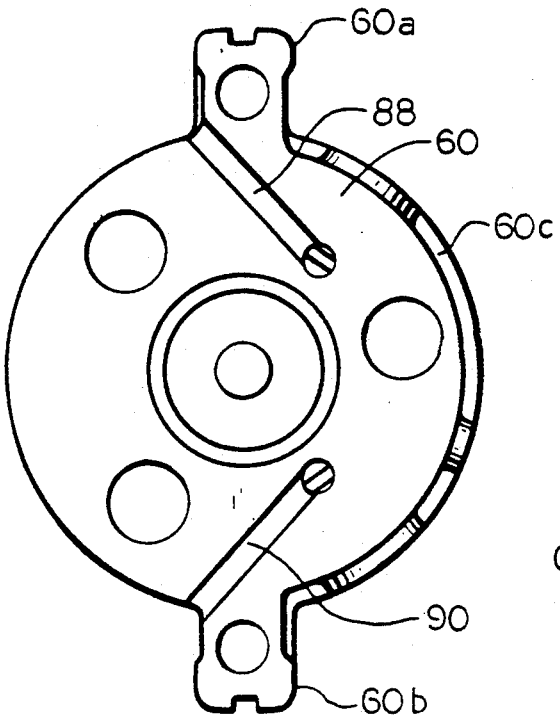
FIG. 7 is a end elevational view of an element of the variable camshaft timing system of FIGS. 2-6.
Figure 8:
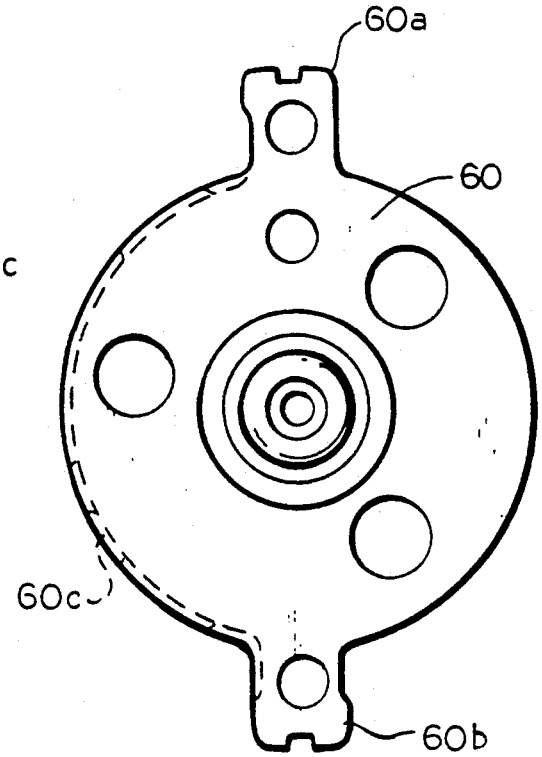
FIG. 8 is an elevational view of the element of FIG. 7 from the opposite end thereof.
Figure 6:
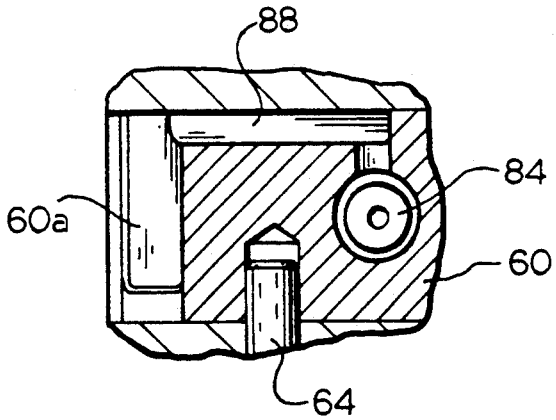
FIG. 6 is a sectional view taken along line 6—6 of FIG. 3.
Figure 9:
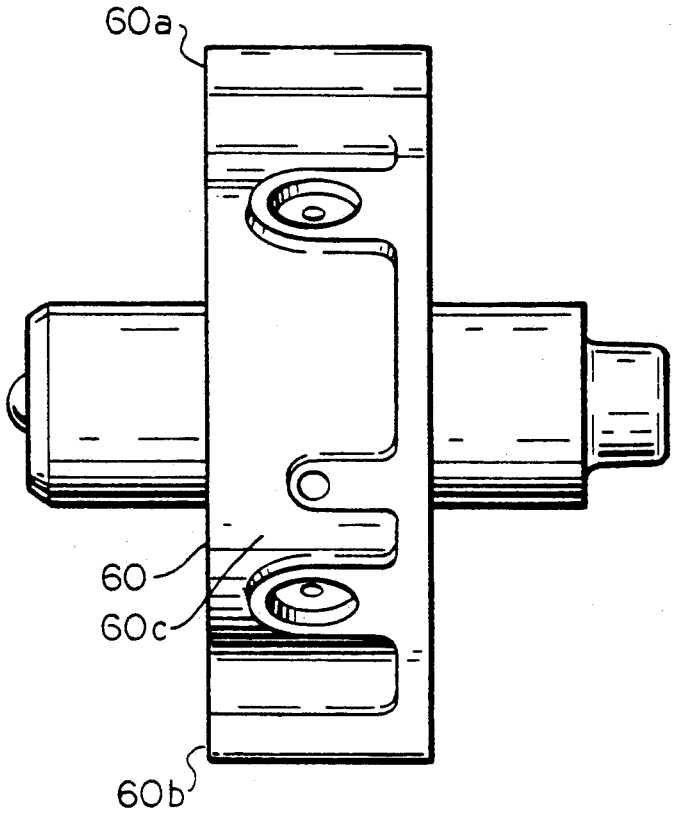
FIG. 9 is a side elevational view of the element of FIGS. 7 and 8.
Figure 10:
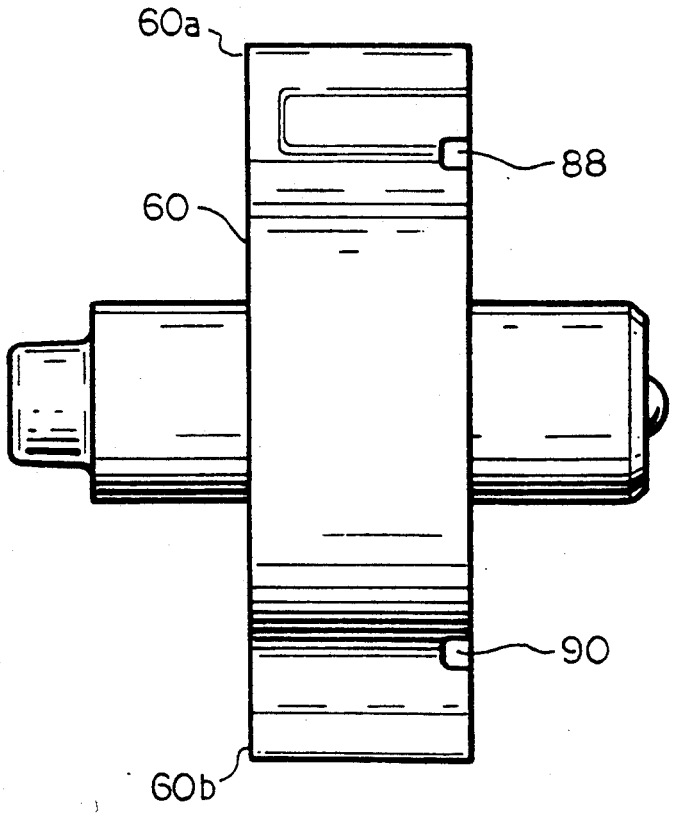
FIG. 10 is an elevational view of the element of FIG. 9 from the opposite side thereof.

The pressure within the cylinder 134 is controlled by a solenoid valve 106, preferably of the pulse width modulated (PWM) type, in response to a control signal from a closed loop feedback system 108, as previously discussed. After initial calibration, the phase measurement and compensation stage 107 processes a signal corresponding to the raw phase angle $\theta_1$ between the camshaft 26 and the crankshaft, not shown, and compensates for any inaccuracies, resulting in a compensated phase value, $\theta_2$. After being subjected to a synchronous filter 25, the filtered compensated phase value $\theta_f$ 30 is compared to a predetermined set point, r, 35 (in the control law stage 108) and the PWM duty cycle is issued to the solenoid 106. With the spool 100 in its null position when the pressure in the cylinder 134 is equal to one-half the pressure in the portion 98*a*, as heretofore described, the on-off pulses of the solenoid 106 will be of equal duration; by increasing or decreasing the on duration relative to the off duration, the pressure in the cylinder 134 will increased or decreased relative to such one-half level, thereby moving the spool 100 to the right or to the left, respectively. The solenoid 106 receives engine oil from the main engine oil gallery (MOG) 130 through an inlet line 114 and selectively delivers engine oil from such source to the cylinder 134 through a supply line 138. As is shown in FIGS. 4 and 5, the cylinder 134 may be mounted at an exposed end of the camshaft 26 so that the piston 134*a* bears against an exposed free end 100*c* of the spool 100. In this case, the solenoid valve 106 is preferably mounted in a housing 134*b* which also houses the cylinder 134*a*.

Makeup oil for the recesses 32*a*, 32*b* of the sprocket 32 to compensate for leakage therefrom is provided by way of a small, internal passage 120 within the spool 100, from the passage 98*a* to annular space 98*b* of the cylindrical member 98, from which it can flow into the inlet line 82. A check valve 122 is positioned within the passage 120 to block the flow of oil from the annular space 98*b* to the portion 98*a* of the cylindrical member 98.

The vane 60 is alternating urged in clockwise and counter clockwise directions by the torque pulsation in the camshaft 26 and these torque pulsations tend to oscillate the vane 60, and, thus, the camshaft 26, relative to the sprocket 32. However, in the FIG. 11 position of the spool 100 within the cylindrical member 98, such oscillation is prevented by the hydraulic fluid within the recesses 32*a*, 32*b* of the sprocket 32 on opposite sides of the lobes 60*a*, 60*b*, respectively, of the vane 60, because no hydraulic fluid can leave either of the recesses 32*a*, 32*b*, since both return lines 94, 98 are blocked by the position of the spool 100. If, for example, it is desired to permit the camshaft 26 and vane 60 to move in a counter clockwise with respect to the sprocket 32, it is only necessary to increase the pressure within the cylinder 134 to a level greater than one-half that in the portion 98*a* of the cylindrical member. This will urge the spool 100 to right and thereby unblock the return line 94. In this condition of the apparatus, counter clockwise torque pulsations in the camshaft 26 will put fluid out of the portion of the recess 32*a* and allow the lobe 60*a* of vane 60 to move into the portion of the recess which has been emptied of hydraulic fluid. However, reverse movement of the vane will not occur as the pulsations in the camshaft become oppositely directed unless and until the spool 100 moves to the left, because of the blockage of the fluid flow through the return line 96 by the land 100*b* of the spool 100. Thus, large pressure variations induced by camshaft torque pulses will not affect the condition of the system, eliminating the need to synchronize the opening and closing of the spool valve 92 with individual torque pulses. While illustrated as a separate closed passage in FIG. 11, the periphery of the vane 60 actually has an open oil passage slot, element 60*c* in FIGS. 2–10, which permits the transfer of oil between the portion of the recess 32*a* on the right side of the lobe 60*a* and the portion of the recess 32*b* on the right side of the lobe 60*b*, which are the nonactive sides of the lobes 60*a* and 60*b*; thus, counter clockwise movement of the vane 60 relative to the sprocket 32 will occur when flow is permitted through return line 94 and clockwise movement will occur when flow is permitted through return line 96.

Further, the passage 82 is provided with an extension 82*a* to the nonactive side of one of the lobes 60*a* or 60*b*, shown as the lobe 60*b*, to permit a continuous supply of makeup oil to the nonactive sides of the lobes 62*a* and 62*b* for better rotational balance, improved damping of vane motion, and improved lubrication of the bearing surfaces of the vane 60.

The elements of the structure of FIGS. 2–10 which correspond to the elements of FIG. 11, as described above, are identified in FIGS. 2–10 by the referenced numerals which were used in FIG. 11, it being noted that the check valves 84 and 86 are disc type check valves in FIGS. 2–10 as opposed to the ball type check valves of FIG. 11. While this type check valves are preferred for the embodiment of FIGS. 2–10, it is to be understood that other types of check valves can also be used.

Alternate Embodiments of the Present Invention

In FIG. 1*d*, an alternate embodiment of the VCT control law 108 is shown utilizing a single-loop configuration. The set point, r 35, is pre-processed by a filter, F(s) 35*a* prior to subtracting the feedback signal $\Theta_f$ 30.

The resulting error, $e_2$ 34, is then processed by the PI control block 218 and phase-lead block 318, resulting in the PWM duty cycle. Thus, it is an object of this alternate embodiment of the present invention to incorporate the advantages of the control law shown in FIGS. 1*b* and *c* into a single-loop configuration.

FIG. 1*e* is an alternate embodiment of the present invention which illustrates an expanded closed loop feedback system including variation compensation and disturbance feed-forward 608. The gain of this hydromechanical system depends on a number of variables such as hydraulic supply pressure, engine speed, oil temperature and natural crankshaft/camshaft orientation. In order to counteract the phenomena in the controller 208, the net effect of all the variables is estimated and the proportional gain, $K_p$, is increased as response decreases. The controller 100 anticipates disturbance phenomena by adjusting the null duty cycle, $U_{null}$ 611, according to an estimate of the net effect. An estimate, Δ null 609, is determined as a nonlinear function of pressure, temperature and the predetermined set point 35. It is then subtracted from a nominal null, $U_o$ 610, to give an overall value, $U_{null}$ 611, used in the control loop.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. In an internal combustion engine having a rotatable crankshaft and a rotatable camshaft (26), said camshaft (26) being position variable relative to said crankshaft, being subject to torque reversals during the rotation thereof, having a vane (60) with at least one lobe (60*a*, 60*b*) secured to said camshaft (26) for rotation therewith, and having a housing (32) mounted on said camshaft (26) for rotation with said camshaft (26) and for oscillation with respect to said camshaft (26), said housing (32) having at least one recess (32*a*, 32*b*) receiving the at least one lobe (60*a*, 60*b*) of said vane (60) and permitting oscillation of the at least one lobe (60*a*, 60*b*) within the at least one recess (32*a*, 32*b*) as the housing (32) oscillates with respect to said camshaft (26), a device comprising:

means for transmitting rotational movement from said crankshaft to said housing (26);

means for varying the position of said housing (32) relative to said camshaft (26) in reaction to torque reversals in said camshaft (26), said means delivering hydraulic fluid to said vane (60);

check valve means (84, 86) functionally positioned between said housing (32) and said means for varying the position of said housing (32) to eliminate the need for blocking a backflow of hydraulic fluid by the operation of said means for varying the position of said housing (32);

actuating means (106) for supplying hydraulic fluid to said means for varying the position of said housing (32);

means for initial calibration (105) of said means for varying the position of said housing (32), said means for initial calibration (105) automatically calculating a phase offset;

means for generating pulses (27, 28) in accordance with the rotational movement of said crankshaft and said camshaft (26);

means for sensing (27*a*, 28*a*) said pulses, said sensing means (27*a*, 27*b*) transmitting said pulses to be further processed;

means for determining (107) a raw phase angle between said crankshaft and said camshaft (26), said determining means (107) receiving said pulses from said sensing means (27*a*, 27*b*), said determining means (107) utilizing said pulses for computing said raw phase angle;

means for compensating (107) said signal corresponding to said raw phase angle for problems encountered during the generation of said pulses; said compensating means (107) transmitting said compensated signal (20) to be further processed; and, means for controlling (108) said actuating means (106), said controlling means (108) receiving said compensated signal (20), comparing said compensated signal (20) to a predetermined setpoint (35), generating a PWM duty cycle in response to said comparison, and issuing said duty cycle to said actuating means (106).

2. The device according to claim 1 wherein said housing (32) comprises a sprocket (32) oscillatingly journalled on said camshaft (26), said sprocket (32) connected to said crankshaft by a chain drive (38).

3. The device according to claim 1 wherein said means for varying the position of the housing (32) comprises a hydraulic cylinder (134) and a proportional spool valve (92), the position of said spool valve (92) being controlled by the pressure of the hydraulic fluid contained in said cylinder (134).

4. The device of claim 1 wherein said actuating means (106) comprises a solenoid valve (106), said solenoid valve (106) controlling the flow of hydraulic fluid to said hydraulic cylinder (134).

5. The device according to claim 4 wherein said solenoid valve (106) is of the pulse width modulated (PWM) variety.

6. The device of claim 1 wherein said means for controlling (108) said actuating means (106) comprises:

means to control proportional gain (208, 408);

means to control integral gain (208, 408);

means to compensate for phase-lead (308, 508); and, means to compensate for outside disturbances (608).

7. The device of claim 1 wherein said means for controlling (108) said actuating means (106) further comprises a means for filtering (35*a*) a predetermined set point (35) in a single-loop system.

8. The device of claim 1 wherein said means for controlling (108) said actuating means (106) further comprises at least one means of filtering (25) said compensated signal (20) to minimize the presence of high frequency oscillations, whereby producing a filtered signal (30).

9. In an internal combustion engine having a rotatable crankshaft and a rotatable camshaft, the camshaft being position variable relative to the crankshaft and being subject to torque reversals during the operation thereof, the method comprising:

generating pulses in accordance with the rotational movement of both said crankshaft and said camshaft;

sensing said pulses and transmitting said pulses for processing;

initially calibrating said camshaft position relative to said crankshaft after receiving said pulses by automatically calculating and implementing a phase offset;

calculating a raw phase angle between said crankshaft and said camshaft utilizing pulses subsequent in time to said initial calibration;

issuing a signal corresponding to said raw phase angle for further processing;

compensating said signal corresponding to said raw phase angle for discrepancies created during the generation of said pulses;

receiving said compensated signal, comparing said compensated signal to a predetermined setpoint, and transmitting a PWM duty cycle to an actuating means for delivering hydraulic fluid from a main oil gallery to a means for varying the position of a housing;

varying the position of a housing relative to said camshaft in response to torque reversals in said camshaft, said housing mounted to said camshaft, said camshaft having at least one vane, said housing having at least one recess, said housing being rotatable about said camshaft;

eliminating the need for blocking a backflow of said hydraulic fluid by utilizing a check valve means functionally positioned between said camshaft/-housing combination and said actuating means; and, transmitting rotational movement from said crankshaft to said housing;

10. The method of claim 9 wherein said housing comprises a sprocket oscillatingly journalled on said camshaft, said sprocket connected to said crankshaft by a chain drive.

11. The method according to claim 9 wherein said means for varying the position of the housing comprises a hydraulic cylinder and a proportional spool valve, the position of said spool valve being controlled by the pressure of the hydraulic fluid contained in said cylinder.

12. The method of claim 9 wherein said actuating means comprises a solenoid valve, said solenoid valve controlling the flow of hydraulic fluid to said hydraulic cylinder.

13. The method according to claim 12 wherein said solenoid valve is of the pulse width modulated (PWM) variety.

14. The method of claim 9 wherein the step of compensating said signal further comprises:

controlling proportional gain;

controlling integral gain;

compensating for phase-lead; and, compensating for outside engine disturbances.

15. The method of claim 9 further comprising the step of filtering a predetermined set point in a single-loop system.

16. The method of claim 9 further comprising the step of filtering said compensated signal to minimize the presence of high frequency oscillations.

17. The method according to claim 9 wherein said means for varying the position of said housing relative to said camshaft comprises means for permitting the position of said housing to move in a first direction relative to said camshaft in reaction to a torque pulse in said camshaft in a first direction, means for preventing the position of said housing from moving relative to said camshaft in a second direction in reaction to a torque pulse in said camshaft in a second direction, and means for selectively reversing said first and second directions of the movement of said housing relative to said camshaft with respect to said first and second directions of torque pulses in said camshaft.

18. The method according to claim 17 wherein said at least one recess is capable of sustaining hydraulic pressure, wherein said at least one lobe divides said at least one recess into a first portion and a second portion, and wherein the varying of the position of said housing relative to said camshaft comprises:

transferring hydraulic fluid into one of said first portion and said second portion of said recess.

19. The method according to claim 18 wherein the varying of the position of said housing relative to said camshaft further comprises;

simultaneously transferring hydraulic fluid out of the other of said first portion and said second portion of said recess.

20. The method according to claim 18 wherein said hydraulic fluid is engine lubricating oil from said main oil gallery of the engine.

* * * * *